US008522842B2

(12) United States Patent
Sharkey et al.

(10) Patent No.: US 8,522,842 B2
(45) Date of Patent: Sep. 3, 2013

(54) VIAL STABILIZER

(76) Inventors: Heather R. Sharkey, Ransom Canyon, TX (US); Jason E. Sharkey, Ransom Canyon, TX (US)

( * ) Notice: Subject to any disclaimer, the term of this patent is extended or adjusted under 35 U.S.C. 154(b) by 411 days.

(21) Appl. No.: 12/815,070

(22) Filed: Jun. 14, 2010

(65) Prior Publication Data

US 2010/0313993 A1 Dec. 16, 2010

Related U.S. Application Data

(60) Provisional application No. 61/187,087, filed on Jun. 15, 2009.

(51) Int. Cl.
*B65B 1/04* (2006.01)

(52) U.S. Cl.
USPC ..... 141/374; 141/241; 141/247; 141/364; 248/145.3; 248/311.3; 222/181.1

(58) Field of Classification Search
USPC ..... 141/1, 2, 18, 234, 241, 247, 319, 141/363–364, 366, 375; 211/74, 85; 248/145.3, 311.3; 222/181.1, 185.1
See application file for complete search history.

(56) References Cited

U.S. PATENT DOCUMENTS

| | | | | | |
|---|---|---|---|---|---|
| 1,503,298 | A * | 7/1924 | Campbell | ..... | 211/31 |
| 3,561,595 | A * | 2/1971 | Weggeland | ..... | 206/757 |
| 4,974,806 | A * | 12/1990 | Matern | ..... | 248/499 |
| 5,794,671 | A * | 8/1998 | Smith | ..... | 141/319 |
| 6,684,922 | B1 * | 2/2004 | Alston et al. | ..... | 141/375 |

* cited by examiner

*Primary Examiner* — Jason K Niesz
(74) *Attorney, Agent, or Firm* — Susanne M. Moore

(57) ABSTRACT

A method and apparatus for stabilizing vials during a contents transfer, the apparatus having a flat base from which vertical arms rise from each end, and having a stabilizer band segment above and parallel to each side of the flat base to provide stabilizing support to at least one fluid vial when the fluid vial is up-ended over a base vial during a contents transfer.

12 Claims, 3 Drawing Sheets

VIAL STABILIZER

CROSS REFERENCE TO RELATED APPLICATIONS

This application claims the benefit of provisional patent application 61/187,087 filed Jun. 15, 2009 by the present inventors and the application is hereby incorporated by reference in its entirety.

STATEMENT REGARDING FEDERALLY SPONSORED RESEARCH OR DEVELOPMENT

Not Applicable

NAMES OF PARTIES TO JOINT RESEARCH AGREEMENT

Not Applicable

REFERENCE TO SEQUENCE LISTING

Not Applicable

DESCRIPTION OF ATTACHED APPENDIX

Not Applicable

BACKGROUND OF THE INVENTION

1. Field of the Invention

The disclosed invention relates to a holder for stabilizing vials during reconstitution, infusion or fluid transfer between vials.

2. Description of Related Art

Many products, especially in the healthcare industry, are stored in a freeze dried or powdered formulation rather than in a liquid form. This is done for a variety of reasons, including to increase the shelf life of the medication by preventing premature degradation of the drug. Another common reason is to reduce the weight and size of the product, thus decreasing shipping and packaging costs. Due to this common practice of packaging compositions in a freeze dried, powdered or lyophilized form, users, and especially health care workers, frequently encounter the need to reconstitute a vial of a dry formulation to a liquid form so that it may be used. In the medical field, reconstitution is often performed so the medication can then be administered to the patient via oral, injection or other methods.

A common practice employed by health care workers in order to accomplish reconstitution of dried medicine is to fill a syringe with diluent and then inject the diluent into the top stopper of the dried medication vial, using a needle on the end of the syringe. In some cases this practice is not practical as the volume of diluent required is greater than what can fit in a syringe. In that instance, the health care worker resorts to attaching a needle, spike or rigid cannula to a bottle of diluent and then turning the diluent bottle upside down over the top of the medication bottle to allow the fluid contents to transfer from the diluent bottle to the medication bottle. The latter is a common practice, particularly in the field of home infusion therapy and to some extent in healthcare fields in general.

The above described practice invites issues surrounding safety, stability and efficiency. When the diluent vial, is upended over the medication bottle, and held precariously only by the needle, spike or cannula, the top vial tips and moves. At best it leans wildly. To avoid a disastrous result incurred by the diluent vial falling off or becoming disengaged from the medication bottle, the healthcare worker must hold the diluent vial manually over the top of the medication vial for several minutes for the fluid to infuse. Often multiple vials must be reconstituted for one patient encounter. During this tedious process the healthcare worker's hands are engaged in holding the vials and the healthcare worker cannot perform other activities.

The above employed practices are slow, inefficient, unprofessional and dangerous. The vials of medication are frequently very expensive and must be held so they do not fall and break. They must also be held so the top vial does not inadvertently detach. Were the top vial to detach, the patient could be injured by the needle or the sterility of the vial and its contents could be compromised should the needle or cannula touch other surfaces.

There is a need for an efficient, safe, professional way to hold vials during the reconstitution of medications or the transfer of fluids from one vial to another. Such a method and apparatus must be relatively inexpensive, easy to break down and pack, small and light enough to transport, and easy and fast to use.

NOTATION AND NOMENCLATURE

Certain terms are used throughout the following description to refer to particular method components. As one skilled in the art will appreciate, design and manufacturing companies may refer to a component by different names. This document does not intend to distinguish between components that differ in name but not function.

In the following discussion, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection or through an indirect connection via other intermediate devices and connections. Moreover, the term "method" means "one or more components" combined together. Thus, a method can comprise an "entire method" or "sub methods" within the method.

The terms "bottle" and "vial" are used interchangeably and have the same or substantially similar meaning when used herein.

The terms "band" and "strap" are used interchangeably and have the same or substantially similar meaning when used herein.

SUMMARY OF THE INVENTION

The disadvantages in the prior art are solved by the disclosed method and apparatus for holding and stabilizing vials of medication and vials of diluents during the transfer of fluids.

The disclosed apparatus comprises a flat base of large enough area to accommodate a plurality of bottles or vials lined up sequentially. In the preferred embodiment, the apparatus has a vertical arm extending up from each end of the base and has a slider arm and knob for purposes of height adjustment to accommodate vials of varying height. Stretched across the top of the device, being looped over or otherwise attached to each vertical arm, is a stabilizer band that may be a closed loop band or may comprise two independent bands. The stabilizer band may have elastic properties for ease of application and removal.

The disclosed method and apparatus allows the healthcare worker to line up one or more bottles of dried formulation along the base, attach a needle, cannula or spike to the bottle of diluent, and then up-end the diluent bottle over the bottle of dried formulation to safely and efficiently reconstitute multiple bottles of medication or other product concurrently. The apparatus safely stabilizes the bottles, preventing the possibility of contamination, needle stick, breakage, spillage, or waste. Use of the apparatus enables the healthcare worker to do other necessary tasks, rather than holding each bottle of diluent individually while waiting for reconstitution to slowly occur.

As home care infusion time is often billed by the hour, minutes are valuable. The quicker the healthcare worker is able to deliver the vital and expensive medications to the patients, the greater the savings to the patient and the healthcare agency.

Home care infusion workers and home health nurses typically must travel to and from patient homes. Any equipment they transport with them must be very easily portable and storage efficient.

The disadvantages described herein are solved by a method and apparatus for safely stabilizing vials during fluid transfer or reconstitution of a dried formulation.

It is an objective of the disclosed invention to provide a small tool to enable more efficient and professional medication reconstitution or fluid transfer, and with an apparatus that is easily dismantled and compactly packed for storage or transport.

It is an objective of the disclosed invention to reduce the possibility of contamination during medication reconstitution or fluid transfer.

It is an objective of the disclosed invention to provide a method and apparatus whereby the health care worker does not have to physically hold the vials during medication reconstitution or fluid transfer.

BRIEF DESCRIPTION OF THE DRAWINGS

The application makes no claim for the structure of certain objects depicted in the photos and drawings, such as drawings of vials or bottles, and they are considered prior art.

The drawings contained herein represent preferred embodiments of the invention and are not intended to limit the scope. For a detailed description of various embodiments, reference will now be made to the accompanying illustrative drawings in which.

DETAILED DESCRIPTION OF THE PREFERRED EMBODIMENTS

Figure 1:
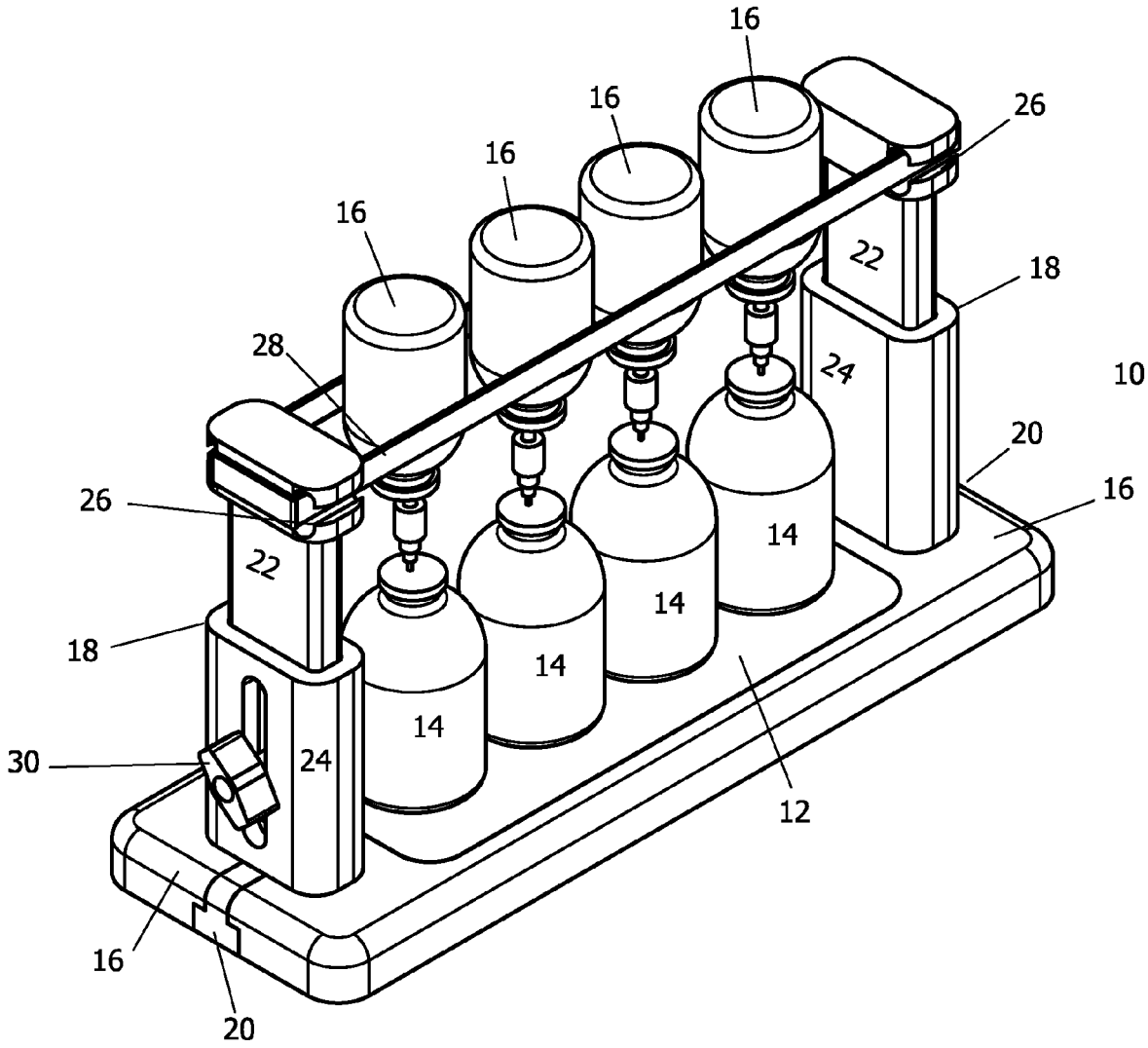
FIG. 1 illustrates a front view of a preferred embodiment of the apparatus.

FIG. 1 illustrates a front view of a disclosed preferred embodiment for the disclosed bottle stabilizer apparatus 10. The base 12 of the apparatus 10 may be of varying sizes. The prototype developed by the inventor employed a base 12 that was four inches wide, fourteen inches long and six inches tall, although any deviation from the expressed measurements is acceptable in order to accommodate various types and sizes of vials including medication vials 14 and diluent vials 16. The base 12 may be of any stable composition and may include wood, plastic, composite, metal, rubber, glass or other stable flat surface. In the preferred embodiment a lightweight plastic composite base 12 was used.

The base 12 may have flat felt, rubber or other soft small discs or feet to protect the surface on which the base 12 sits.

A vertical arm 18 rises from each end of the base 12. The base 12 may have a groove 20 such that the vertical arm 18 can slide into the groove 20 and lock into place.

Each vertical arm 18 may be of varying heights but in the preferred embodiment each is between four inches and eight inches in height. In order to provide for adjustment of the apparatus 10 to support bottles of varying heights, the vertical arm 18 may comprise two parts, one part being an adjustment slider arm 22 and the other part being a slider arm housing 24, into which the slider arm 22 may retract or protrude from. The adjustment slider arm 22 extends up from the slider arm housing 24 by at least one half inch or a length sufficient for grasping between two fingers and sufficient for secure placement of a stabilizer band 28 around the top. In the preferred embodiment, the top of the adjustment slider arm 22 has a notch 26 such that the band 28 rests in the notch 26 and thus does not unintentionally slide up or down on the slider arm 22.

To accommodate vials of varying sizes, the adjustment slider arm 22 may be raised or lowered as needed. In the preferred embodiment, located on the exterior surface of the slider arm housing 26 is a twistable adjustment knob 30 having a central leg protruding through a slot in the slider arm housing 24 and capable of making contact with the slider arm 22. The knob 30 may be loosened, withdrawing the central leg, so that the user can raise or lower the slider arm 22 as desired. Once the slider arm 22 is at the desired height, the user may tighten the knob 30, protruding the central leg of the knob to make contact with the slider arm 22 to hold the slider arm 22 in place.

The slider arm 22 and the slider arm housing 26 may be made of a variety of materials but in a preferred embodiment are made of a lightweight metal. They may also be composite plastic or any other suitable rigid composition. The slider arm housing 26 may be of varying size but in a preferred embodiment is between five and seven inches tall, between one half inch and one inch wide and between one and two inches across. These measurements may vary depending on the specific contemplated use of the apparatus and size of the bottles or vials being used.

Although medicinal use is contemplated as a viable use of the described method and apparatus, the vial stabilizer described herein could be employed for a variety of non-medical uses as well, including any situation where a fluid transfer from one bottle to another was necessitated and support of the top bottle would be of assistance.

It is also pointed out that the disclosed apparatus should not require FDA approval as it is not a device that participates in any way with the medicinal contents or the actual fluid transfer, rather it is merely a rack or stabilizer for the vials, much in the way that an intravenous pole may hold an intravenous bag or a medicine cup holds a patient's medicine prior to the patient consuming it. Further, the device could be used to support any type of non-medical bottles or vials during fluid transfer as well.

Figure 2:
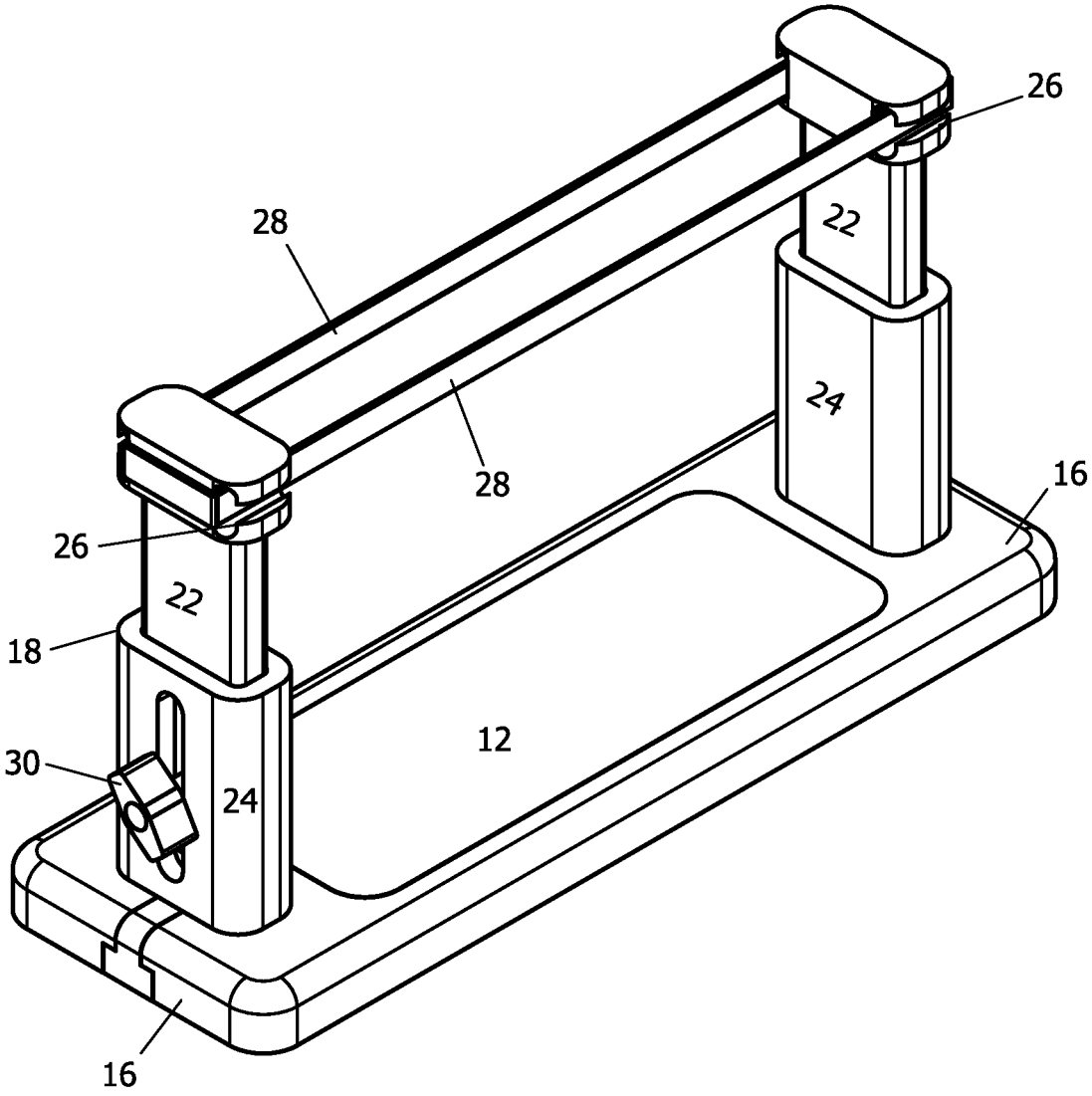
FIG. 2 illustrates a front view of a preferred embodiment of the apparatus.

FIG. 2 illustrates a front view of the apparatus without vials in place, illustrating the base and features more clearly and showing the apparatus itself as it could be used to support vials or bottles during any medical or non-medical fluid transfer.

Figure 3:
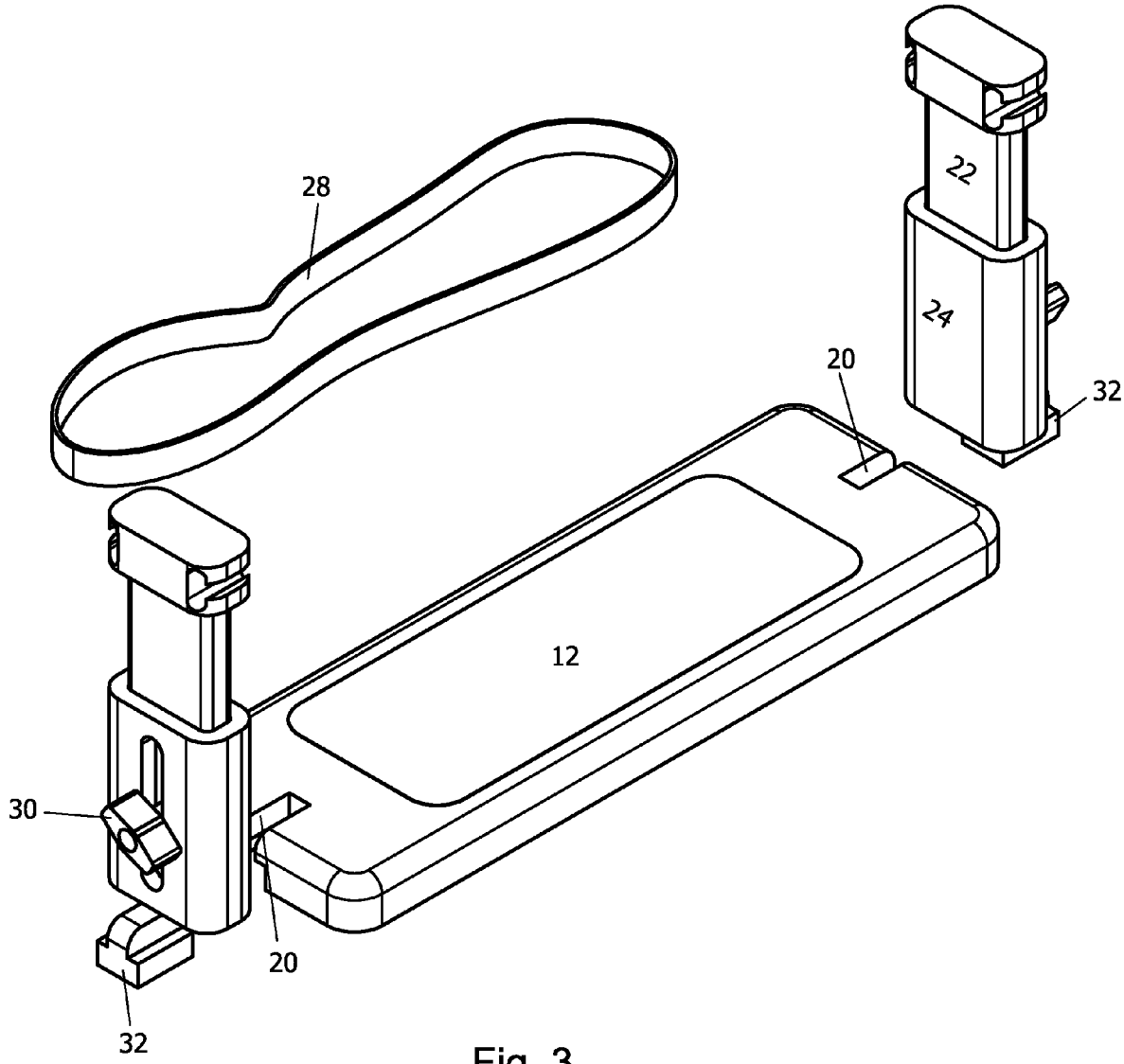
FIG. 3 illustrates an exploded view of a preferred embodiment of the apparatus.

FIG. 3 illustrates an exploded view of the apparatus revealing its parts in greater detail. This view better depicts the groove 20 where, in the preferred embodiment, the vertical arm 18 has a corresponding protruding edge 32 at its end surface, capable of sliding into the groove 20 and locking into place. This feature enables the device to be easily dismantled and compactly stored for travel or during periods of nonuse. In an alternative embodiment, the vertical arm 18 may simply be permanently attached to the base 12, or temporarily attached in some other fashion.

In the preferred embodiment, the adjustment knob 30 has, as pictured, a twistable exterior portion which has a central leg protruding into the slider arm housing 24 as shown to where it can make contact with the slider arm 22. When the adjustment knob 30 is turned to the left the central leg retracts from the slider arm 22 so that the slider arm 22 may be raised or lowered. When the knob 30 is turned to the right the central leg of it protrudes and makes contact with the slider arm 22 in order to hold the vertical arm 18 in place upon reaching the desired height.

In the disclosed apparatus, the stabilizer band 28 can comprise either a closed loop or two single bands, with or without elastic properties, provided the stabilizer band travels from the top of one vertical arm 18 to the other, along each side of the apparatus 10. The stabilizer band may loop over the outside of the top of the vertical arms 18, may clip into a notched area 26, or by any reasonable means, affix to the top of each vertical arm 18. The band 28 should be of a size that it is taut upon being looped over the top of each vertical arm 18, or clipped into its place on the arm 18. Although a rubberized band 28 is depicted in the preferred embodiment, any type of stretchy, taut stabilizer of varying width and thickness can be used.

In the preferred embodiment, as depicted in FIG. 1, the medication bottle 14 sits on the base 12. A diluent bottle 16 is up-ended over the medication bottle 14. The diluent bottle 16 is stabilized by resting between the inner sides of a closed loop band 28 or between the inner sides of two individual bands 28.

If desired the base may incorporate a plurality of slightly sunken round spots for each bottom vial to sit on, providing even more bottle stability.

The method and apparatus disclosed herein effectively keep the bottles from tipping over, allow the transfer to be conducted on multiple bottles or containers at once, and represent a safer, more efficient way to effectuate the reconstitution of medicine or other contents, solving multiple problems inherent in the prior art.

The apparatus disclosed is designed to set up quickly, be disassembled quickly, and, once disassembled, take up very little space.

Although the figures disclosed herein represent a preferred embodiment of an apparatus for stabilizing bottles or vials during the transfer of fluids or medicines, the invention should not be limited to this specific apparatus. The method disclosed herein may be achieved by any similar device that provides for stabilization of one or more bottles during a contents transfer.

While the disclosed method and apparatus has been described in conjunction with the preferred embodiments thereof, many changes, modifications, alterations and variations will be apparent to those skilled in the art. The invention should therefore not be limited to the particular preferred embodiment disclosed but should include all embodiments that could fall within the scope of the claims.

Accordingly, the preferred embodiments of the invention shown in the drawings and described in detail above are intended to be illustrative, not limiting, and various changes may be made without departing from the spirit and scope of the invention as defined by the claims set forth below.

What is claimed is:

1. A holder for stabilizing two or more vials during a contents transfer between vials, the holder comprising:

a flat base on which to place at least one medication vial, the base having a first end, a second end, a first side and a second side;

a first vertical arm rising from the first end of the base and a second vertical arm rising from an opposing end of the base, each vertical arm having a top end and a bottom end and being capable of height adjustment and further being releasably engaged to the base by means of a protruding edge from the bottom end of the vertical arm, wherein the protruding edge corresponds to a groove in the end of the base such that the vertical arm can slide into the groove and lock into place prior to use and similarly be slid out of the groove in order to dismantle the holder for storage;

a stabilizer band loop traveling from the top end of the first vertical arm to the top end of the opposing vertical arm in a horizontal path parallel to and superior to the base wherein the stabilizer band loop stabilizes at least one diluent vial, the diluent vial resting between the inner sides of the loop when the diluent vial is up-ended over the medication vial during a contents transfer.

2. The holder described in claim 1 wherein the height of the vertical arm is adjusted by an adjustment slider arm and a slider arm housing, wherein the adjustment slider arm is raised or lowered in the slider arm housing.

3. The slider arm housing of claim 2 wherein on the exterior of the slider arm housing is an opening through which a twistable knob protrudes for engaging with the slider arm for purposes of releasably holding the slider arm in place at a desired height.

4. The holder of claim 1 wherein the base is rectangular and of length that a plurality of medication vials may be placed sequentially in a line.

5. The holder of claim 1 wherein each end of the stabilizer band loops over the top end of each vertical arm.

6. The holder of claim 2 wherein the top of the adjustment slider arm further comprises a notch into which the stabilizer band loop is held.

7. A holder for stabilizing two or more vials during a contents transfer, the holder comprising:

a flat base for holding one or more medication vials in an upright position, the holder further comprising two vertical arms, each rising upward from opposing ends of the base and each arm further comprising an adjustment slider arm and a slider arm housing, for adjusting the height of the arm, the holder further comprising at least one stabilizer band traveling in a horizontal path parallel to and superior to the base, each end of the band affixed to the outside of the top end of each vertical arm, the stabilizer band supporting one or more diluent vials while they are up-ended on top of the one or more medication vials to effectuate a contents transfer.

8. The holder of claim 7 wherein the top of each slider arm further comprises a notch into which the stabilizer band is held.

9. The holder of claim 7 wherein on the exterior of the slider arm housing is an opening through which a twistable knob protrudes for engaging with the slider arm for purposes of releasably holding the slider arm in place at a desired height.

10. A rack for stabilizing two or more containers, one up-ended on top of another one, during a transfer of contents, comprising:

a flat base on which to set at least one medication vial;

a first vertical arm rising from a first end of the base and a second vertical arm rising from an opposing end of the base, each vertical arm having a top end and a bottom end and further being releasably engaged to the base by means of a protruding edge from the bottom end of the vertical arm, wherein the protruding edge corresponds to a groove in the end of the base such that the vertical arm can slide into the groove and lock into place prior to use;

a stabilizer band encircling the open area above the flat base by traveling in a closed oblong path from the outside of the top end of the first vertical arm to the outside of the top end of the second vertical arm, wherein the inner sides of the stabilizer band support at least one diluent vial, when the diluent vial is up-ended over the medication vial during a contents transfer.

11. The rack of claim 10 wherein the vertical arm is further comprised of an adjustment slider arm and a slider arm housing, wherein the adjustment slider arm may be raised or lowered in the slider arm housing in order to accommodate vials of varying heights.

12. The rack of claim 10 wherein the top of each slider arm further comprises a notch into which the stabilizer band is held.

* * * * *